United States Patent [19]

Koide et al.

[11] 4,438,716

[45] Mar. 27, 1984

[54] MULTI-STITCH SEWING MACHINE

[75] Inventors: Akio Koide; Yoshikazu Ebata, both of Tokyo, Japan

[73] Assignee: Janome Sewing Machine Co., Ltd., Tokyo, Japan

[21] Appl. No.: 493,044

[22] Filed: May 12, 1983

Related U.S. Application Data

[63] Continuation of Ser. No. 230,600, Feb. 2, 1981, abandoned.

[30] Foreign Application Priority Data

Feb. 1, 1980 [JP] Japan ..... 55-9941

[51] Int. Cl.[3] ..... D05B 1/14

[52] U.S. Cl. ..... 112/168

[58] Field of Search ..... 112/163, 168; 192/27

[56] References Cited

U.S. PATENT DOCUMENTS 4,267,786 5/1981 Hanyu et al. ..... 112/168

4,343,250 8/1982 Hanyu et al. ..... 112/168

FOREIGN PATENT DOCUMENTS 160948 4/1921 United Kingdom ..... 112/168

1267361 3/1972 United Kingdom ..... 112/168

2065729 12/1979 United Kingdom ..... 112/168

*Primary Examiner*—Werner H. Schroeder

*Assistant Examiner*—Andrew M. Falik

*Attorney, Agent, or Firm*—Michael J. Striker

[57] ABSTRACT

A selecting device for a double-function sewing machine having a single drive motor with the sewing machine including a first stitch forming mechanism to produce one type of stitch, a second stitch forming mechanism to produce another type of stitch, and a transmission for transmitting the rotation of the drive motor to the first and second stitch forming mechanism. The selecting device includes a first clutch operated into an operative position to contact the first stitch forming mechanism to a transmission and operated into an inoperative position to disconnect that mechanism from the transmission, and a second clutch operated into an operative position to connect the second stitch forming mechanism to the transmission and operated into an inoperative position to disconnect that mechanism from the transmission. A manually operated dial is mounted on the housing of the sewing machine, which is connected to a lever mechanism operated in one direction to hold the first mentioned clutch in the inoperative position and release the second clutch into the operative position. The lever mechanism is manually operated in another direction to hold the second clutch in the inoperative position and release the first clutch into the operative position.

1 Claim, 8 Drawing Figures

MULTI-STITCH SEWING MACHINE

This application is a continuation of application Ser. No. 230,600, filed Feb. 2, 1981, abandoned.

BACKGROUND OF THE INVENTION

The invention relates to a sewing machine, and more particularly relates to a selecting device of a double-function sewing machine which may produce different types of stitches, such as the ordinary lock stitches and the overlock stitches. The invention is directed to a sewing machine such as disclosed in the copending U.S. Pat. application Ser. No. 860,589 U.S. Pat. No. 4,267,786 which is provided with two separate stitch forming mechanisms for different types of stitches, each operatively and selectively connected through a transmission device to a single drive source such as a machine driving motor.

According to the invention, a selecting device is manually and selectively operated from an external dial to activate a clutch to connect one of the stitch forming mechanisms to the machine drive motor and at the same time to inactivate another clutch to disconnect the other of the stitch forming mechanisms from the machine driving motor. In addition, both stitch forming mechanisms are disconnected from the machine driving motor if a thread winding mechanism of the sewing machine is operated.

So far, home sewing machines have been structured only to produce lock stitches. Recently it has been generally desired to have a sewing machine which functions to provide lock stitching and overlock stitching which are indispensable for producing a well finished stitching work, and accordingly various constructions regarding such a sewing machine have been provided. However, since the sewing machine requires two different types of stitch forming mechanisms, it becomes bulky, complex in structure and difficult to operate, and also awkward in design.

SUMMARY OF THE INVENTION

The present invention aims to eliminate such defects and disadvantages of the prior art, and it is a primary object of the invention to provide a selecting device of simple structure which is manually and selectively operated to connect one of the lock stitch forming mechanisms and the overlock stitch forming mechanism to the machine driving motor and disconnect the other of the mechanisms from the machine driving motor. It is another object of the invention to provide a selecting device which is positively and securely operated to safeguard the disconnected stitch forming mechanism from the abrupt and unexpected drive by the machine driving motor. It is still another object of the invention to disconnect both of the stitch forming mechanisms from the machine driving motor when the thread winding mechanism is operated.

The other features and advantages of the invention will be apparent from the following description of a preferred embodiment in reference to the attached drawings.

DETAILED DESCRIPTION OF THE INVENTION

Figure 1:
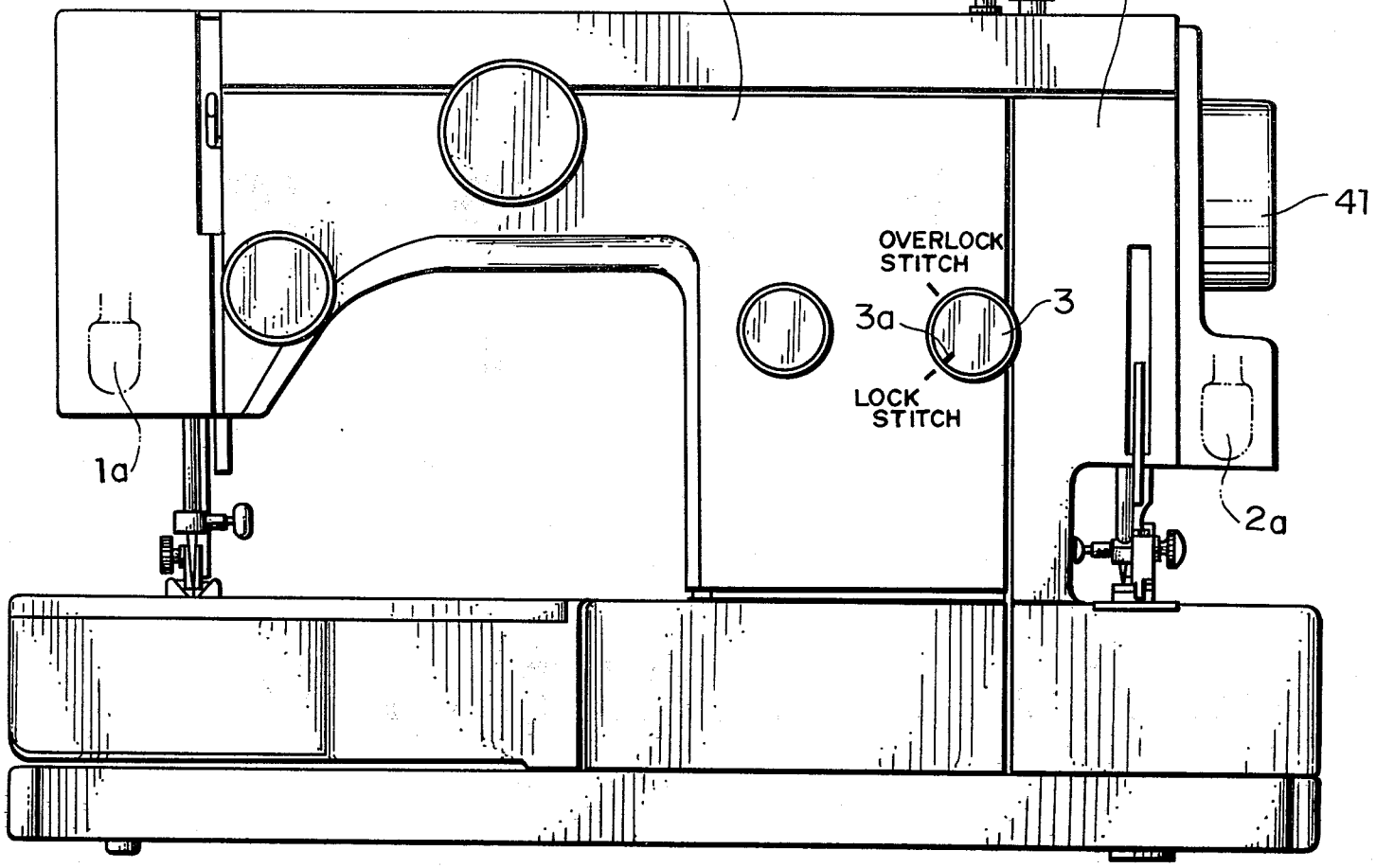
FIG. 1 is a front elevational view of a sewing machine of the invention.

With reference to FIG. 1, the double-function sewing machine has a housing 1 in which a lock stitching mechanism (not shown) is arranged, and another housing 2 in which an overlock stitching mechanism (not shown) is arranged. These two stitching mechanisms are selectively connected to a single machine drive motor (not shown) by way of a clutch mechanism and a transmission mechanism when a selecting dial 3 is selectively operated. According to the invention, the lock stitching mechanism is connected to the machine drive motor when the mark 3*a* of the dial 3 is positioned in alignment with a mark of LOCK STITCH provided on the housing 1 while the overlock stitching mechanism is disconnected from the machine drive motor. On the other hand, the overlock stitching mechanism is connected to the machine drive motor when the mark 3*a* of the dial 3 is positioned in alignment with a mark of OVERLOCK STITCH while the lock stitching mechanism is disconnected from the machine drive motor.

Figure 2:
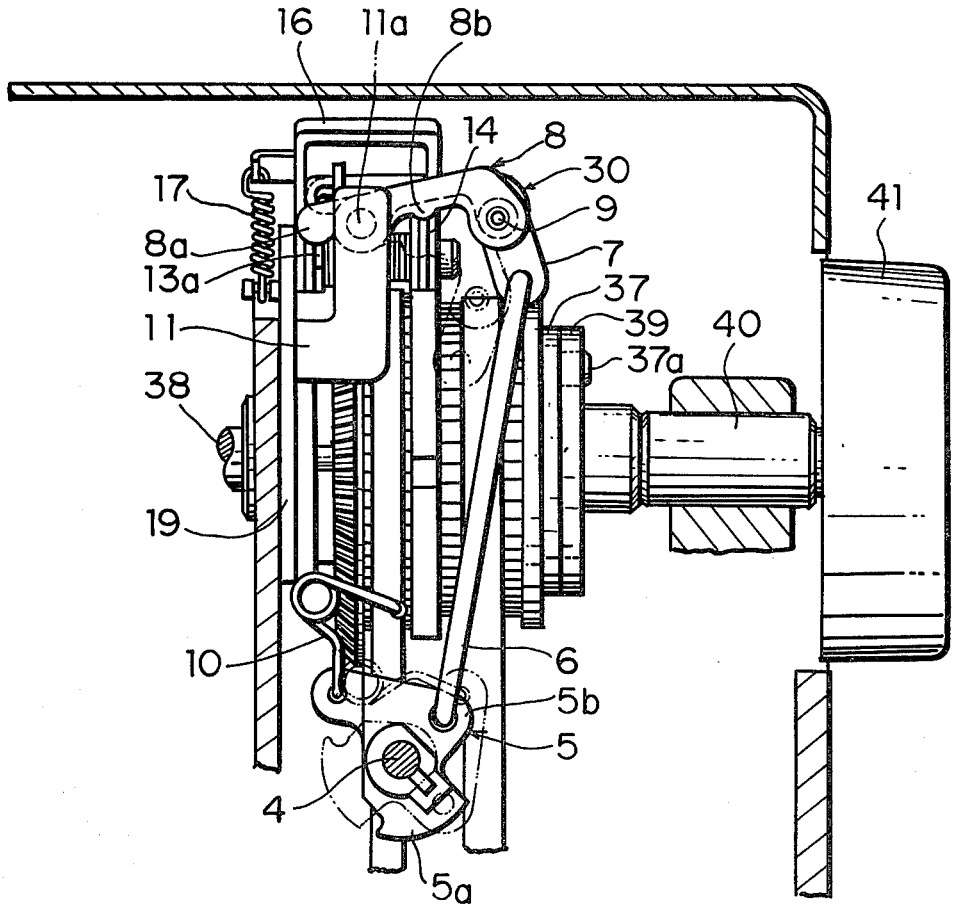
FIG. 2 is a front elevational view of an inner mechanism of the sewing machine according to the invention.
Figure 7:
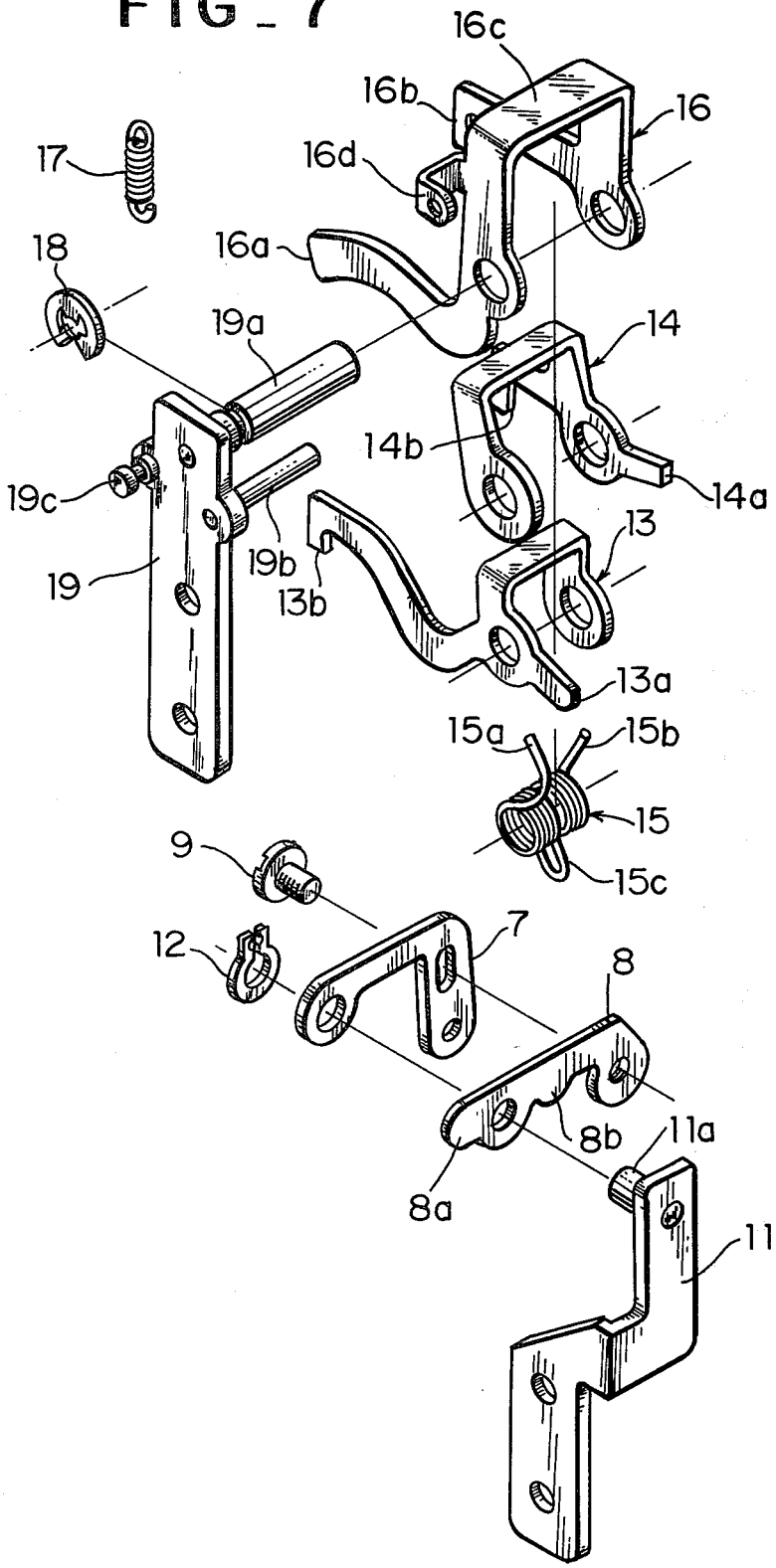
FIG. 7 is an exploded view of a selecting device of the invention.

FIG. 2 shows a selecting mechanism of the lock stitching mechanism and the overlock stitching mechanism, in which a control shaft 4 is turnably mounted in the housing 1. The control shaft 4 has one end protruded out of the housing 1 to carry thereon the selecting dial 3 in FIG. 1. The control shaft 4 carries thereon a switching cam 5 within the housing 1. The switching cam 5 has a cam lobe 5*a* to operate a microswitch (not shown) to turn on or off a lamp 1*a* for the lock stitching mechanism, and a cam lobe 5*b* to operate another microswitch (not shown) to turn on or off a lamp 2*a* for the overlock stitching mechanism. The switching cam 5 is connected at the cam lobe 5*b* thereof to one end of an arm 7 by means of a rod 6. The arm 7 is at the other end thereof turnably mounted on a pivot 11*a* of a support 11 secured to a bracket 19, and is maintained there by a washer 12 together with another arm 8, which is connected to the arm 7 by a screw 9 as shown in FIG. 7. The arm 8 has operating parts 8*a*, 8*b* formed at one end and the intermediate thereof respectively for acting on three levers 13, 14, 16 each turnably mounted on a transverse shaft 19*a* of the bracket 19 as shown in FIG. 7. These 1evers 13, 14, 16 are prevented from axial displacement by a washer 18. A coi1 spring 15 is mounted on the transverse shaft 19*a*, and has a lower projection 15*c* and opposite end projections 15*a*, 15*b*. The lower projection 15*c* of the spring is stopped by a transverse pin 19*b* of the bracket 19, and the upper projection 15*a* of the spring 15 is pressed against the lever 13 and another upper projection 15*b* is pressed against the lever 14, thereby to normally bias the levers 13, 14 in the counterclockwise direction in FIG. 7. A tension spring 17 is at one end connected to a projected part 16*d* of the lever 16 and is at the other end anchored to a projection 19*c* of the bracket 19. Thus the lever 16 is normally biased in the counterclockwise direction in FIG. 7. The counterclockwise movement of the levers 13, 14 is limited by the operating parts 8*a*, 8*b* of the arm 8 respectively engaging a projection 13*a* of lever 13 and a projection 14*a* of the lever 14.

Figure 4:
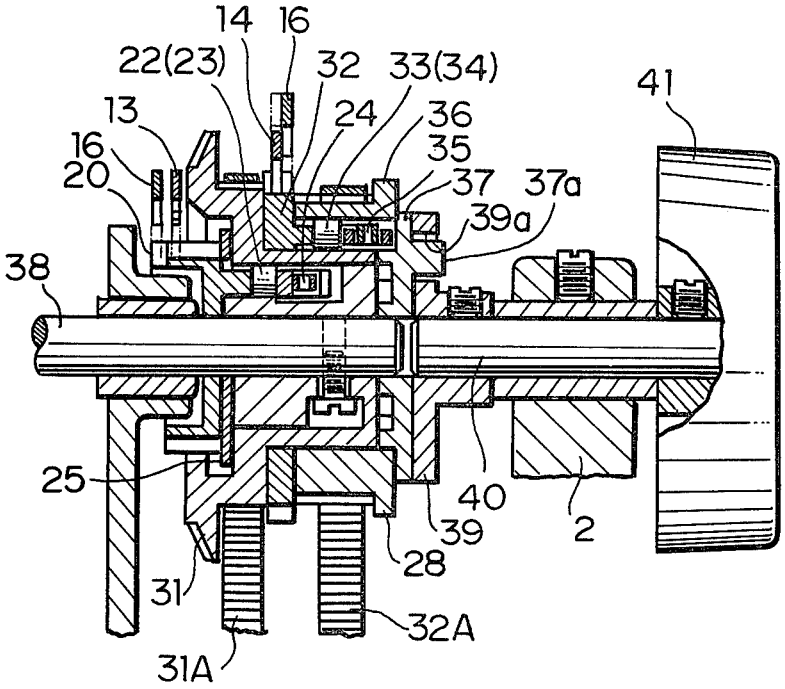
FIG. 4 is a front elevational view of the mechanism shown in a vertical section.
Figure 8:
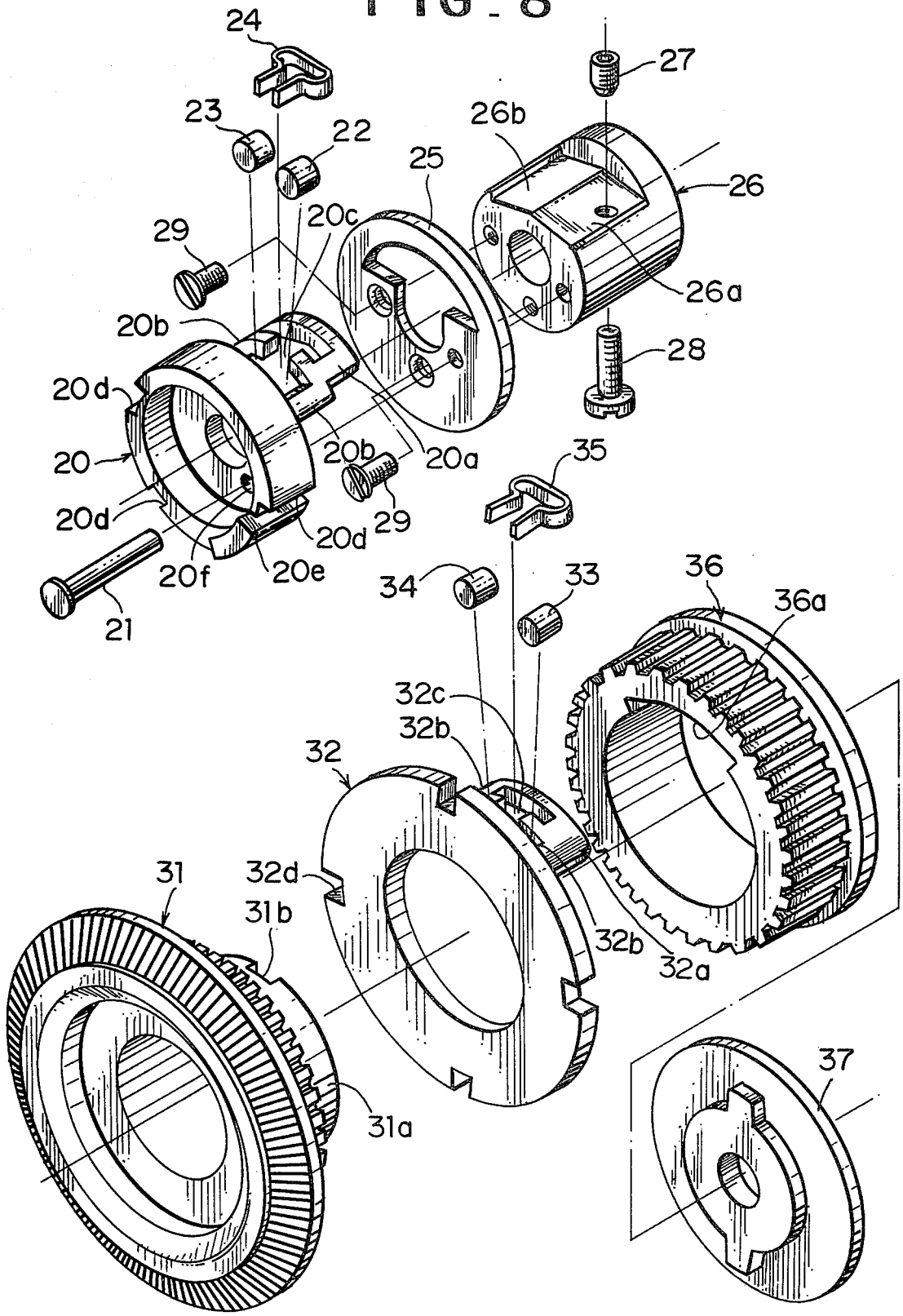
FIG. 8 is an exploded view of a clutch mechanism of the invention.

With reference to FIG. 8, a first stop cam 20 is turnably mounted on an upper drive shaft 38 as shown in FIG. 4 and has a predetermined number of axial grooves 20*d* formed in the peripheral flange thereof. These grooves 20*d* are selectively engagable by the end 13*b* of the lever 13. A second stop cam 32 is turnably mounted on an axial cylinder 31*a* of a belt wheel 31 which is rotatably mounted on a bushing 26 secured to one end of the upper drive shaft 38 by means of fastening screw 28. The stop cam 32 has a predetermined number of grooves 32*d* formed in the periphery thereof. These grooves 32*d* are selectively engageable by the end 14*b* of the lever 14. As shown in FIG. 7, the lever 16 has a pair of spaced ends 16*a*, 16*b*. The end 16*a* is designed to engage an axially extended flange part 20*e* of the stop cam 20, and the end 16*b* is designed to selectively engage the grooves 32*d* of the stop cam 32 when the thread winding operation is carried out. Normally the lever 16 is lifted up against the action of tension spring 17 by an arm of thread winding mechanism (not shown), so that the ends 16*a*, 16*b* may be spaced from the stop cams 20, 32.

Figure 5:
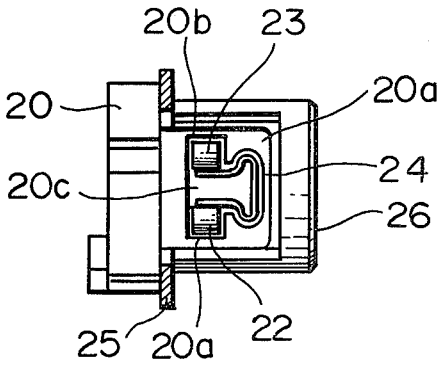
FIG. 5 is a plan view of a first clutch of the invention partly shown in section.

A clutch mechanism of the sewing machine will now be explained in reference to FIGS. 4 and 8. The bushing 26 has a cut out as shown formed at the upper part thereof with the bottom faces 26*a*, 26*b* each sloping outwardly and downwardly from the center of the cutout. A pair of rollers 22, 23 are placed on the bottom faces 26*a*, 26*b* and spaced from each other by a leaf spring 24 until the rollers are pressed against opposite stops 20*b*, 20*b* formed in the cutout 20*c* of a tongue 20*a* axially extended from the stop cam 20 through a stop disk 25 which is secured to the bushing 26 by fastening screws 29 as shown in FIG. 5. As shown in FIG. 8, the stop cam 20 is connected to the bushing 26 by a pin 21 passing through an arcuate slot 20*f* formed therein and inserted into the hole of the bushing 26 through the stop member 25, so that the stop cam 20 may be turnable around the pin 21 within a predetermined angular range. The stop member 25 also functions to prevent the axial displacement of the belt wheel 31.

Figure 6:
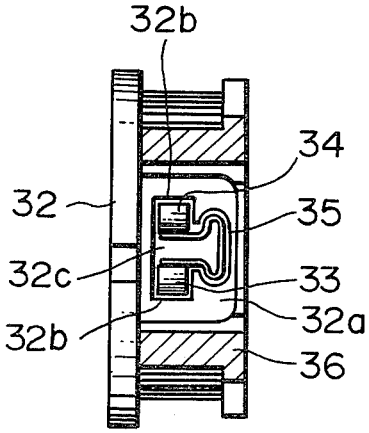
FIG. 6 is a plan view of a second clutch of the invention partly shown in section.

Another belt wheel 36 has an axial groove 36*a* of a predetermined width formed at the inner periphery thereof providing the faces outwardly lowering from the center thereof, and is rotatably mounted on the axial cylinder 31*a* of the belt wheel 31 to provide a chamber defined by a part of the outer face of axial cylinder 31*a* of the belt wheel 31 and the axial cutout 36*a* of the belt wheel 36. Another pair of rollers 33, 34 are placed in the chamber and are spaced from each other by a leaf spring 35 until the rollers are pressed against the opposite stops 32*b* formed in the cutout 32*c* of a tongue 32*a* axially extended from the stop cam 32 into the axial groove 36*a* of the belt wheel 36 as shown in FIG. 6. As shown, the axial cylinder 31*a* of the belt wheel 31 has a groove 31*b* into which part of a transmission disk is fitted which is formed with a lateral projection 37*a* on the outer side thereof and which acts as a stop preventing axial displacement of the belt wheel 36 as shown in FIG. 4. A hand wheel shaft 40 is rotably mounted in the bearing secured to the machine housing 2. The shaft 40 is coaxial with the upper drive shaft 38 and is at one end protruding out of the housing 2 for a hand wheel 41 to be secured thereto. The shaft 40 has also a disk 39 secured to the inner end thereof. The disk 39 is formed with a cutout 39*a* engaged by the lateral projection 37*a* of the transmission disk 37, so that the rotation of the belt wheel 31 may be transmitted to the hand wheel 41.

With the above mentioned structure of the invention, the operation is as follows: If the selecting dial 3 is rotated in the counterclockwise direction to position the indicating mark 3*a* in alignment with the mark LOCK STITCH on the housing 1 as shown in FIG. 1, the cam lobe 5*a* of the switching cam 5 operates the microswitch (not shown) to turn on the lamp 1*a* of the lock stitching mechanism (not shown). At the same time the arm 8 is turned in the counterclockwise direction around the pivot 11*a* by way of the rod 6 as is understood from FIG. 2. Therefore, the lever 13 is turned in the clockwise direction in FIG. 7 against the action of coil spring 15 while the lever 14 is turned in the counterclockwise direction by the action of spring 15. As a result, the end 13*b* of the lever is spaced from one of the grooves 20*d* of the stop cam 20 while the end 14*b* of the lever 14 engages one of the grooves 32*d* of the stop cam 32.

Figure 3:
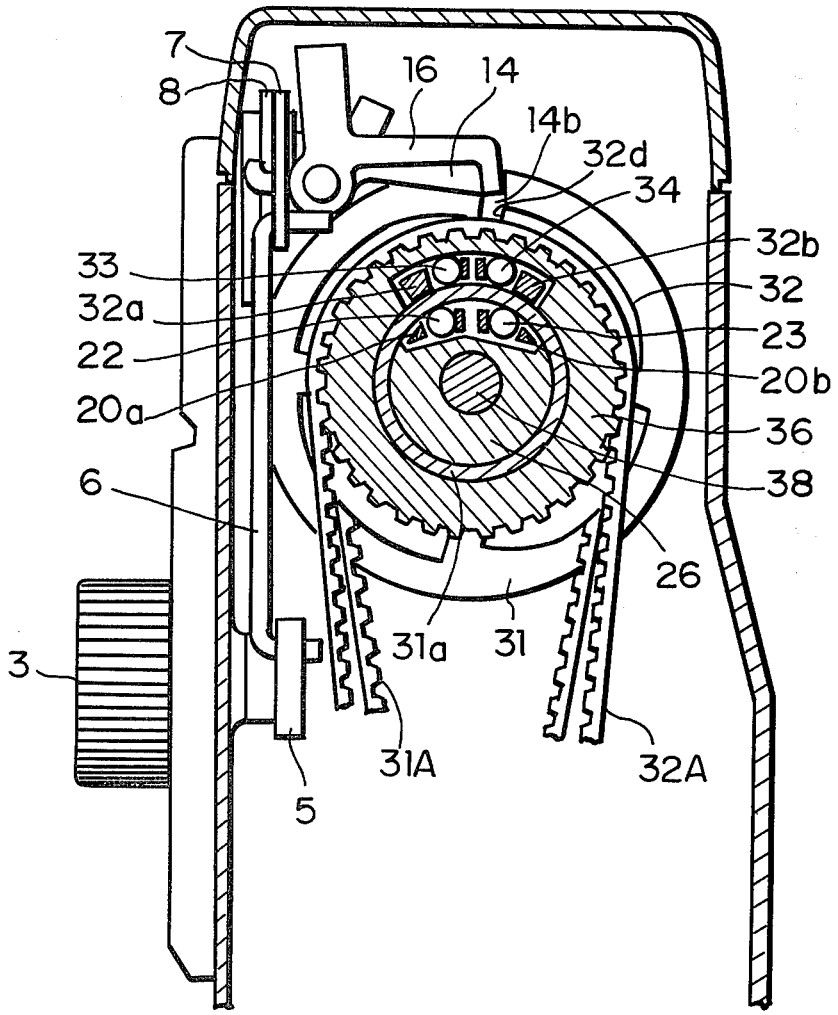
FIG. 3 is a side elevational view of the mechanism shown in a vertical section.

Therefore if the machine drive motor is driven, the belt wheel 31 is rotated in the counterclockwise direction by way of a belt 31A (in FIG. 3). Accordingly the roller 22 is displaced in the same direction to a position, as the belt wheel 31 is rotated, where it is pressed against the inner periphery of the belt wheel 31 and the face 26*a* of the bushing 26. Thus the rotation of the belt wheel 31 is transmitted to the bushing 26, and the upper drive shaft 38 is rotated, and the lock stitching mechanism is operated. On the other hand, since the stop cam 32 is detained by the lever 14, the rollers 33, 34 are held stationary in the positions where these rollers 33, 34 are spaced from the inner peripheral face 36*a* of the belt wheel 36. Therefore the rotation of the belt wheel 31 is not transmitted to the belt wheel 36 which is connected by way of a belt 32A, to the drive shaft of the overlock stitching mechanism (not shown). Thus the latter remains standstill.

In this case, the rotation of the belt wheel 31 is transmitted to the hand wheel 41 by way of the transmission disk 37. Therefore the upper or lower needle position may be adjusted by manual rotation of the hand wheel 41 when the machine drive motor is stopped. If the hand wheel 41 is rotated in the counterclockwise direction in FIG. 3, the upper drive shaft 38 is rotated in the same direction because the roller 22 is displaced to a position where it is pressed against the inner periphery of the belt wheel 31 and the face 26*a* of the bushing 26. On the other hand, if the hand wheel 41 is rotated in the opposite direction, the upper drive shaft 38 is rotated in the same direction because the roller 22 is displaced to a position where it is spaced from the inner periphery of the belt wheel 31 and the roller 23 is displaced to a position where it is pressed against the inner periphery of the belt wheel 31 and the face 26*b* of the bushing 26.

Then if the selecting dial 3 is rotated in the clockwise direction to position the indicating mark 3*a* in alignment with the mark OVERLOCK STITCH on the housing 1, the cam lobe 5*a* releases the microswitch (not shown) to turn off the lamp 1*a* for the lock stitching mechanism. On the other hand, the cam lobe 5*b* operates another microswitch to turn on the lamp 2*a* for the overlock stitching mechanism. At the same time, the arm 8 is turned in the clockwise direction in FIG. 2. Therefore, the lever 13 is released and turned in the counterclockwise direction in FIG. 7 by the action of spring 15. On the other hand, the lever 14 is turned in the clockwise direction against the action of spring 15. As a result, the end 13*a* of lever 13 engages one of the grooves 20*d* of the stop cam 20 while the end 14*a* of lever 14 is spaced from the stop cam 32. Therefore if the machine drive motor is driven, the belt wheel 31 is rotated in the counterclockwise direction by way of the belt 31A. The rotation of the belt wheel 31 is, however, not transmitted to the upper drive shaft 38 because the stop cam 20 is detained by the lever 13 and the rollers 22, 23 are held in the positions where these rollers are spaced from the inner periphery of the belt wheel 31. On the other hand, as the belt wheel 31 is rotated, the axial cylinder 31*a* carrying the rollers 33, 34 displaces the roller 33 to a position where it is pressed against the inner peripheral face 36*a* of the belt wheel 36 and the outer face of the axial cylinder 36*a* of belt wheel 36. Thus the rotation of the belt wheel 31 is transmitted to the belt wheel 36, and therefore the overlock stitching mechanism is operated while the lock stitching mechanism remains standstill. In this case, it is also possible, when the machine drive motor is stopped, to manually rotate the hand wheel 41 in either direction to adjust the upper or lower position of the needle of overlock stitching mechanism. The rotation of the hand wheel 41 is transmitted to the belt wheel 36 through the transmission disk 39, belt wheel 31, roller 33 or 34.

In reference to FIG. 1, a spool pin 42 is provided on the top of the sewing machine. The spool pin 42 is operated in association with a generally known thread winding mechanism (not shown). According to the invention, a bobbin is mounted on the spool pin 42, and the pin 42 is displaced toward the best wheel 31 around a separate pivot (not shown) so that the pin 42 may be rotated by the belt wheel 31 through a rotational member (not shown). Upon the displacement of the spool pin 42, the lever 16 is operatively released from the upper inoperative position. As a result, the lever 16 is turned in the counterclockwise direction by the action of the tension spring 17, and the spaced ends 16*a*, 16*b* engage the grooves 20*d*, 32*d*, of the stop cams 20, 32 respectively. Therefore if the machine drive motor is driven, the belt wheel 31 is rotated, thereby to rotate the spool pin 42. Thus a thread is wound around the bobbin on the spool pin 42. In this case, the rotation of the belt wheel 31 is not transmitted to the upper drive shaft 38 and to the belt wheel 36, and therefore the lock stitching and overlock stitching mechanisms remain stationary.

We claim:

1. A selecting device for a double-function sewing machine having a first stitch forming mechanism including a drive shaft (38) for producing one type of stitch, a second stitch forming mechanism for producing another type of stitch and a single machine drive motor (6), said selecting device comprising a first belt wheel (31) mounted on the drive shaft (38) and being rotatable relative to said drive shaft; first transmission means (31A) connecting the first belt wheel to the machine drive motor; first clutch means (20–24) arranged between the first belt wheel and the drive shaft and being displaceable between an operative position in which said first clutch means connects the first belt wheel to the drive shaft and an inoperative position in which said first clutch means disconnects the first belt wheel from said drive shaft, said first clutch means including a first cam (20); a second belt wheel (36) mounted on the first belt wheel and being rotatable relative to the first belt wheel second transmission means (32A) connecting the second belt wheel to the motor; second clutch means (32–34) arranged between said second belt wheel and said first belt wheel and being displacable between an operative position in which said second clutch means connects said second belt wheel to said first belt wheel and an inoperative position in which said second clutch means disconnects said second belt wheel from said first belt wheel, wherein the first and second clutch means and the first and second belt wheels are mounted on said drive shaft (38), said second clutch means including a second cam (32); and operator-controlled means including a first lever (13) and a second lever (14) and being selectively operated to cause one of said first and second levers to cooperate with one of said first and second cams to thereby displace one of said first and second clutch means into said inoperative position while the other of said first and second levers is held in an inoperative position so that the other of said first and second clutch means may remain in said operative position.

* * * * *